US008407830B1

(12) United States Patent
Kumar

(10) Patent No.: US 8,407,830 B1
(45) Date of Patent: Apr. 2, 2013

(54) MULTI-FUNCTIONAL, RECONFIGURABLE FURNITURE SYSTEM

(76) Inventor: Sivathanu B. Kumar, Tampa, FL (US)

( * ) Notice: Subject to any disclaimer, the term of this patent is extended or adjusted under 35 U.S.C. 154(b) by 388 days.

(21) Appl. No.: 12/802,086

(22) Filed: May 28, 2010

Related U.S. Application Data

(60) Provisional application No. 61/217,613, filed on Jun. 2, 2009.

(51) Int. Cl.
*A47B 85/00* (2006.01)

(52) U.S. Cl. ..... 5/3; 5/2.1; 5/5; 312/240

(58) Field of Classification Search ..... 312/240, 312/237, 235.2, 235.3, 235.4, 235.5, 313, 312/314, 315, 317.1, 317.3, 316; 5/2.1, 133, 5/136, 159.1, 160, 3, 5, 6, 7
See application file for complete search history.

(56) References Cited

U.S. PATENT DOCUMENTS

| | | | | |
|---|---|---|---|---|
| 117,632 | A * | 8/1871 | Hopf's | 5/2.1 |
| 266,860 | A * | 10/1882 | Meissner | 5/164.1 |
| 3,235,888 | A * | 2/1966 | Nystrom | 5/2.1 |
| 3,858,253 | A * | 1/1975 | Lauzon | 5/2.1 |
| 4,793,011 | A * | 12/1988 | Eve | 5/136 |
| 5,033,134 | A * | 7/1991 | Burchett | 5/133 |
| 5,101,524 | A * | 4/1992 | Brandschain | 5/17 |
| 5,913,769 | A * | 6/1999 | Byma et al. | 5/2.1 |
| 6,851,139 | B2 * | 2/2005 | Arason et al. | 5/159.1 |
| 7,013,506 | B2 * | 3/2006 | Revels | 5/149 |
| 7,487,564 | B2 * | 2/2009 | Miller | 5/716 |
| 2006/0107456 | A1 * | 5/2006 | Joseph | 5/2.1 |
| 2007/0289225 | A1 * | 12/2007 | Kern et al. | 52/36.1 |

* cited by examiner

*Primary Examiner* — James O Hansen

(57) ABSTRACT

A back plate has upper, lower and side edges. A central section and two laterally spaced side sections with spaces separating the sections. Shelves are coupled to the back plate in the sections. A cabinet has upper, lower, left side, right side, left, right, left intermediate, and right intermediate plates, a central opening between the left intermediate plate and the right intermediate plate, a left side opening between the left side plate and the left intermediate plate, and a right side opening between the right side plate and the right intermediate plate. A plurality of support panels are coupled to the cabinet and are re-positionable for spanning the openings when the cabinet is in a horizontal orientation whereby the panels will totally cover the openings and provide full support for an inflated mattress.

3 Claims, 9 Drawing Sheets

FIG. 5A
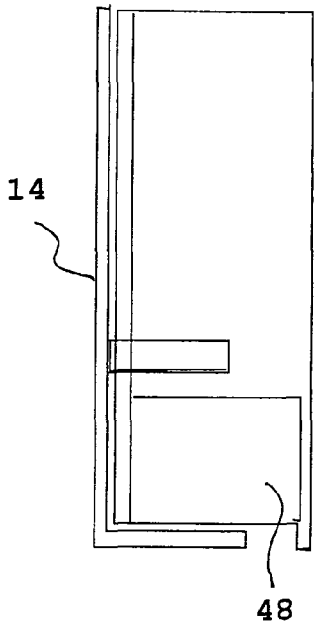
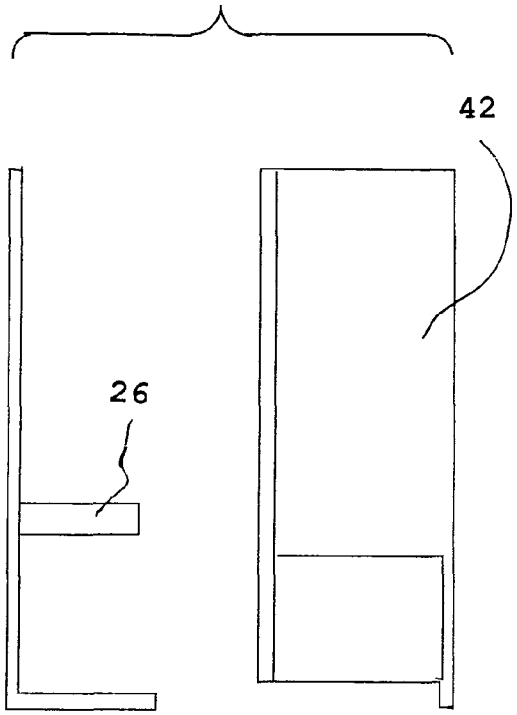
FIG. 5B

MULTI-FUNCTIONAL, RECONFIGURABLE FURNITURE SYSTEM

RELATED APPLICATION

The present non-provisional patent application is based upon Provisional Patent Application Ser. No. 61/217,613 filed Jun. 2, 2009, the subject matter of which is incorporated herein by reference.

BACKGROUND OF THE INVENTION

1. Field of the Invention

The present invention relates to a multi-functional, reconfigurable furniture system and more particularly pertains to for converting a piece of furniture from a cabinet during the day to a bed during the night in a safe, convenient, eye-appealing and economical manner.

2. Description of the Prior Art

The use of furniture systems of known designs and configurations is known in the prior art. More specifically, furniture systems of known designs and configurations previously devised and utilized for the purpose of converting a cabinet used during the day to a bed for use at night are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a multi-functional, reconfigurable furniture system that allows for converting a piece of furniture from a cabinet during the day to a bed during the night in a safe, convenient, eye-appealing and economical manner.

In this respect, the multi-functional, reconfigurable furniture system according to the present invention substantially departs from the conventional concepts and designs of the prior art, and in doing so provides an apparatus primarily developed for the purpose of for converting a piece of furniture from a cabinet during the day to a bed during the night in a safe, convenient, eye-appealing and economical manner.

Therefore, it can be appreciated that there exists a continuing need for a new and improved multi-functional, reconfigurable furniture system which can be used for converting a piece of furniture from a cabinet during the day to a bed during the night in a safe, convenient, eye-appealing and economical manner. In this regard, the present invention substantially fulfills this need.

SUMMARY OF THE INVENTION

In view of the foregoing disadvantages inherent in the known types of furniture systems of known designs and configurations now present in the prior art, the present invention provides an improved multi-functional, reconfigurable furniture system. As such, the general purpose of the present invention, which will be described subsequently in greater detail, is to provide a new and improved multi-functional, reconfigurable furniture system and method which has all the advantages of the prior art and none of the disadvantages.

To attain this, the present invention essentially comprises a back plate, a cabinet, an inflatable mattress and support panels. First provided is the back plate. The back plate has a horizontal upper edge and a parallel lower edge. The upper and lower edges are separated by a height of 6 feet. The back plate has a vertical left side edge and a parallel right side edge.

The left and right side edges are separated by a width of 7 feet. The back plate is vertically positionable against and secured to a wall. A foot plate is attached to the lower edge of the back plate. The foot plate has a width equal to the width of the back plate. The foot plate extends forwardly from the back plate for a depth equal to 25 percent of the height of the back plate. The back plate is formed with a vertical central section and two laterally spaced side sections. Vertical spaces separate the sections. A horizontal major shelf is provided in the central section. Two minor shelves are also provided. One of the minor shelves is in each side section. Two box-shaped shelving assemblies are provided. One shelving assembly is in each side section. The minor shelves and the shelving assemblies have a common width. The major shelf has a width greater than the common width.

Next, a cabinet is provided. The cabinet has a horizontal upper plate and a parallel lower plate. The upper and lower plates of the cabinet are separated by a height of 6 feet. The cabinet has a vertical left side plate and a parallel right side plate. The left and right side plates of the cabinet are separated by a width of 7 feet. The cabinet has a left intermediate plate and a right intermediate plate. A central opening is provided between the intermediate plates. A left side opening is provided between the left side plate and the left intermediate plate. A right side opening is provided between the right side plate and the right intermediate plate. A left housing with front doors is in the left side opening and is secured to the lower plate. The left housing has a height of 1.5 feet. A right housing with front doors is in the right side opening and is secured to the lower plate. The right housing has a height of 1.5 feet. The cabinet is movable between a horizontal orientation and a vertical orientation. In the horizontal orientation the cabinet is positioned upon the floor laterally spaced from the foot plate with the upper and lower plates vertically disposed. In the vertical orientation the cabinet is positioned upon the foot plate and against the back plate and with the intermediate plates separating the major shelf from the minor shelves and with the upper and lower plates horizontally disposed.

Next, an inflatable mattress is provided. The mattress is adapted to be deflated and inserted into one of the housings when the cabinet is in the vertical orientation. The mattress is adapted to be inflated and placed upon the cabinet when in the horizontal orientation.

Lastly, four similarly configured support panels are provided. The support panels are coupled to the cabinet. The panels include a lower panel with hinges for pivoting the foot panel to a position facing the lower panel when in the vertical orientation and to a position spanning the openings when in the horizontal orientation. The panels also include three upper panels with hinges for folding and stacking the three upper panels upon the upper plate when the cabinet is in the vertical orientation. The support panels are re-positionable for spanning the openings when in the horizontal orientation. In this manner, the panels will totally cover the openings and provide full support for the inflated mattress.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-functional, reconfigurable furniture system which has all of the advantages of the prior art furniture systems of known designs and configurations and none of the disadvantages.

It is another object of the present invention to provide a new and improved multi-functional, reconfigurable furniture system which may be easily and efficiently manufactured and marketed.

It is further object of the present invention to provide a new and improved multi-functional, reconfigurable furniture system which is of durable and reliable constructions.

An even further object of the present invention is to provide a new and improved multi-functional, reconfigurable furniture system which is susceptible of a low cost of manufacture with regard to both materials and labor, and which accordingly is then susceptible of low prices of sale to the consuming public, thereby making such multi-functional, reconfigurable furniture system economically available to the buying public.

Even still another object of the present invention is to provide a multi-functional, reconfigurable furniture system for for converting a piece of furniture from a cabinet during the day to a bed during the night in a safe, convenient, eye-appealing and economical manner.

Lastly, it is an object of the present invention to provide a new and improved A back plate has upper, lower and side edges. A central section and two laterally spaced side sections with spaces separating the sections. Shelves are coupled to the back plate in the sections. A cabinet has upper, lower, left side, right side, left, right, left intermediate, and right intermediate plates, a central opening between the left intermediate plate and the right intermediate plate, a left side opening between the left side plate and the left intermediate plate, and a right side opening between the right side plate and the right intermediate plate. A plurality of support panels are coupled to the cabinet and are re-positionable for spanning the openings when the cabinet is in a horizontal orientation whereby the panels will totally cover the openings and provide full support for an inflated mattress.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5A is a side elevational view of the multi-functional, reconfigurable furniture system shown in FIG. 1.

FIG. 5B is a side elevational view similar to FIG. 5A but with the cabinet pulled away from the back plate.

The same reference numerals refer to the same parts throughout the various Figures.

DESCRIPTION OF THE PREFERRED EMBODIMENT

Figure 1:
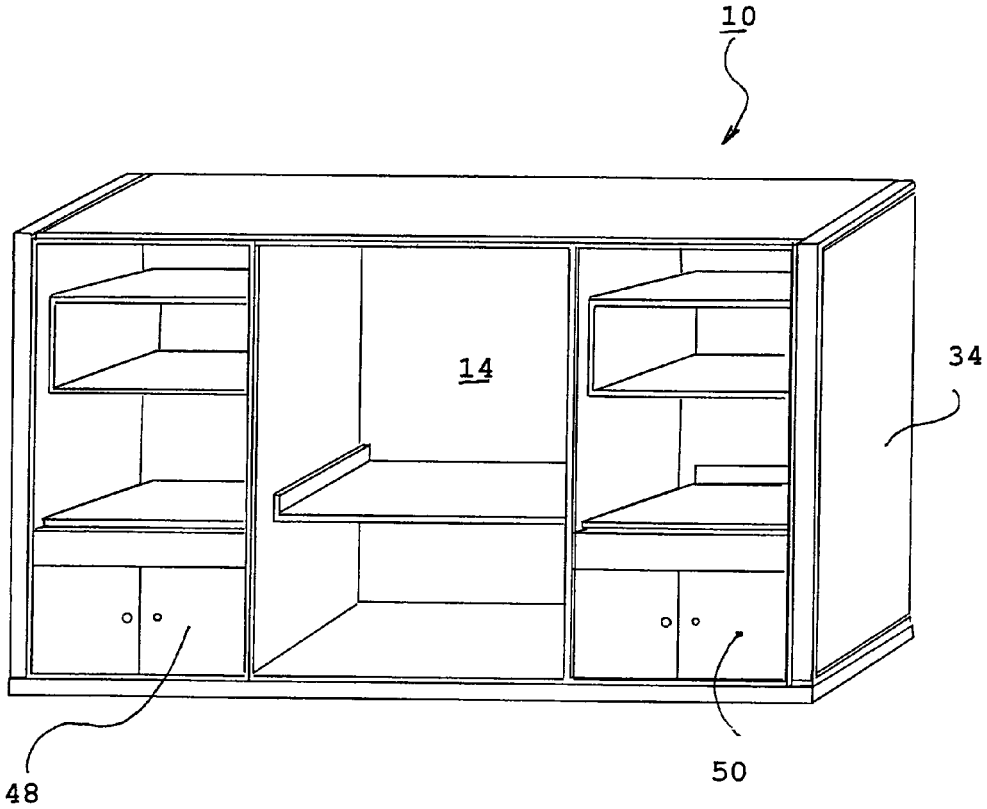
FIG. 1 is a front perspective illustration of a multi-functional, reconfigurable furniture system constructed in accordance with the principles of the present invention.
Figure 2:
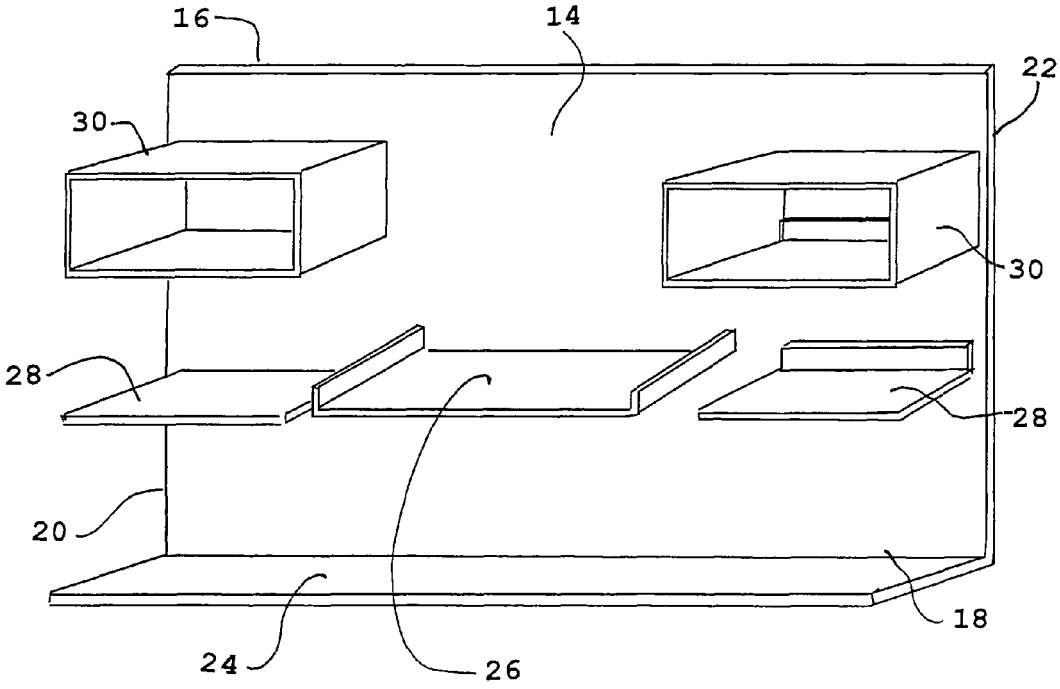
FIG. 2 is a front perspective illustration of the back plate and its shelves as shown in FIG. 1 but with the cabinet removed.
Figure 3:
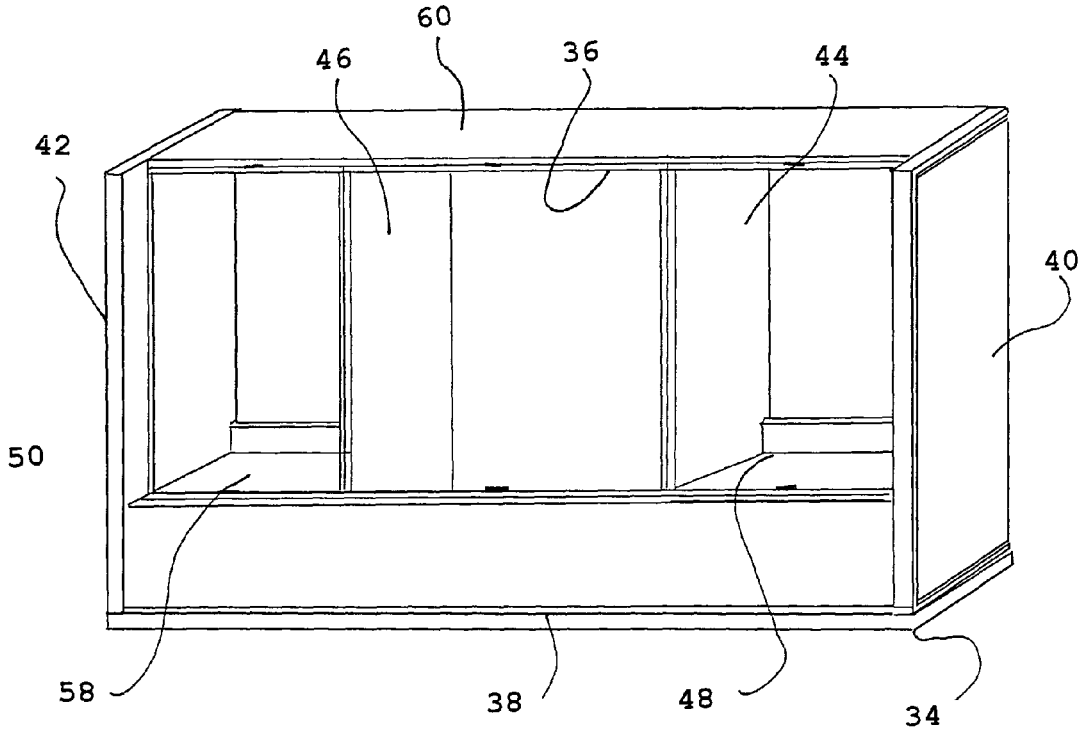
FIG. 3 is a rear perspective illustration of the cabinet shown in FIG. 1 but with the back plate removed.

With reference now to the drawings, and in particular to FIG. 1 thereof, the preferred embodiment of the new and improved multi-functional, reconfigurable furniture system embodying the principles and concepts of the present invention and generally designated by the reference numeral 10 will be described.

The present invention, the multi-functional, reconfigurable furniture system 10 is comprised of a plurality of components. Such components in their broadest context include a back plate, a cabinet, and a plurality of support panels. Such components are individually configured and correlated with respect to each other so as to attain the desired objective.

The multi-functional, reconfigurable furniture system 10 of the present invention is for conversion to a cabinet during the day and a bed during the night. Such conversions are done in a safe, convenient, eye-appealing and economical manner. First provides is a back plate 14. The back plate has a horizontal upper edge 16 and a parallel lower edge 18. The upper and lower edges are separated by a height of 6 feet. The back plate has a vertical left side edge 20 and a parallel right side edge 22. The left and right side edges are separated by a width of 7 feet. Cabinets of other sizes could be readily utilized. The back plate is vertically positionable against and secured to a wall. A foot plate 24 is attached to the lower edge of the back plate. The foot plate has a width equal to the width of the back plate. The foot plate extends forwardly from the back plate for a depth equal to 25 percent of the height of the back plate. The back plate is formed with a vertical central section and two laterally spaced side sections. Vertical spaces separate the sections. A horizontal major shelf 26 is provided in the central section. Two minor shelves 28 are also provided. One of the minor shelves is in each side section. Two box-shaped shelving assemblies 30 are provided. One shelving assembly is in each side section. The minor shelves and the shelving assemblies have a common width. The major shelf has a width greater than the common width.

The back plate and foot plate are shown as a separate plates secured with respect to a wall and a floor. Such plates could, however, be part of the wall and the floor.

Next, a cabinet 34 is provided. The cabinet has a horizontal upper plate 36 and a parallel lower plate 38. The upper and lower plates of the cabinet are separated by a height of 6 feet. The cabinet has a vertical left side plate 40 and a parallel right side plate 42. The left and right side plates of the cabinet are separated by a width of 7 feet. The cabinet has a left intermediate plate 44 and a right intermediate plate 46. A central opening is provided between the intermediate plates. A left side opening is provided between the left side plate and the left intermediate plate. A right side opening is provided between the right side plate and the right intermediate plate. A left housing 48 with front doors is in the left side opening and is secured to the lower plate. The left housing has a height of 1.5 feet. A right housing 50 with front doors is in the right side opening and is secured to the lower plate. The right housing has a height of 1.5 feet. The cabinet is movable between a horizontal orientation and a vertical orientation. In the horizontal orientation the cabinet is positioned upon the floor laterally spaced from the foot plate with the upper and lower plates vertically disposed. In the vertical orientation the cabinet is positioned upon the foot plate and against the back plate and with the intermediate plates separating the major shelf from the minor shelves and with the upper and lower plates horizontally disposed.

Next, an inflatable mattress 56 is provided. The mattress is adapted to be deflated and inserted into one of the housings when the cabinet is in the vertical orientation. The mattress is adapted to be inflated and placed upon the cabinet when in the horizontal orientation. Inflation is preferably through air, but other fluids could be used such as gas or liquid.

Lastly, four similarly configured support panels 58, 60, 62, 64 are provided. The support panels are coupled to the cabinet. The panels include a lower panel 58 with hinges 66 for pivoting the foot panel to a position facing the lower panel when in the vertical orientation and to a position spanning the openings when in the horizontal orientation. The panels also include three upper panels 60, 62, 64 with hinges 68, 70, 72 for folding and stacking the three upper panels 60, 62, 64 upon the upper plate when the cabinet is in the vertical orientation. The support panels are re-positionable for spanning the openings when in the horizontal orientation. In this manner, the panels will totally cover the openings and provide full support for the inflated mattress.

Figure 4A:
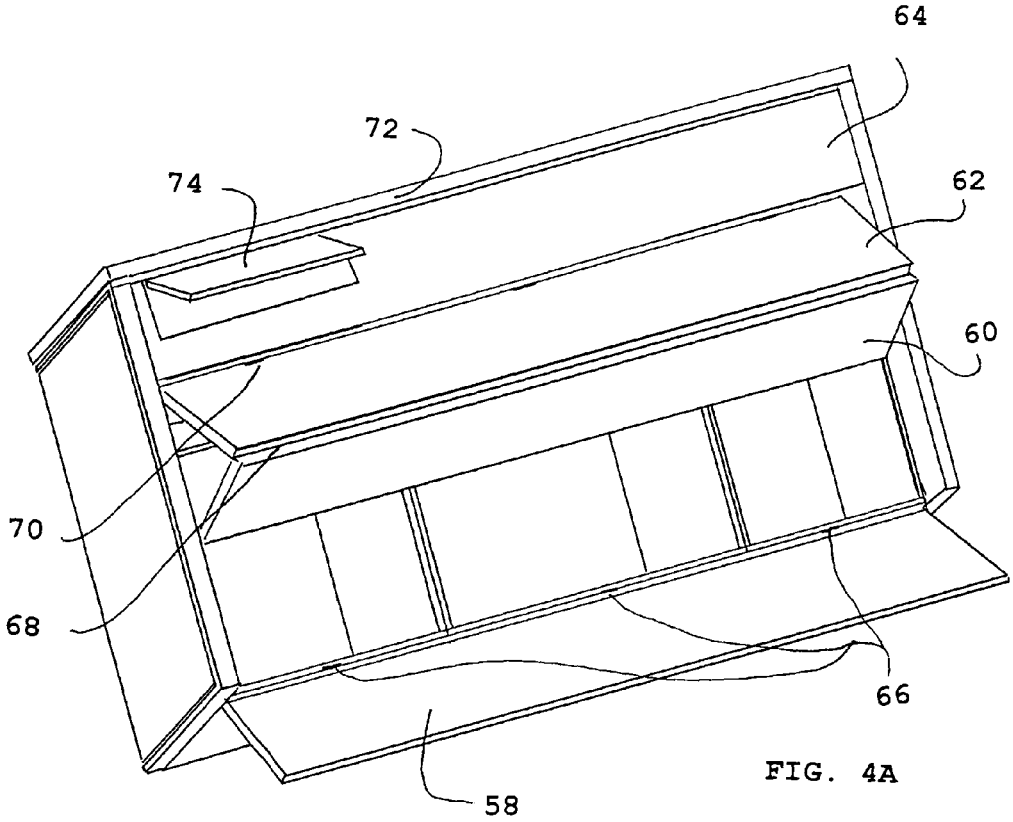
FIG. 4A is a rear perspective illustration similar to FIG. 3 but with the support panels being repositioned.
Figure 4B:
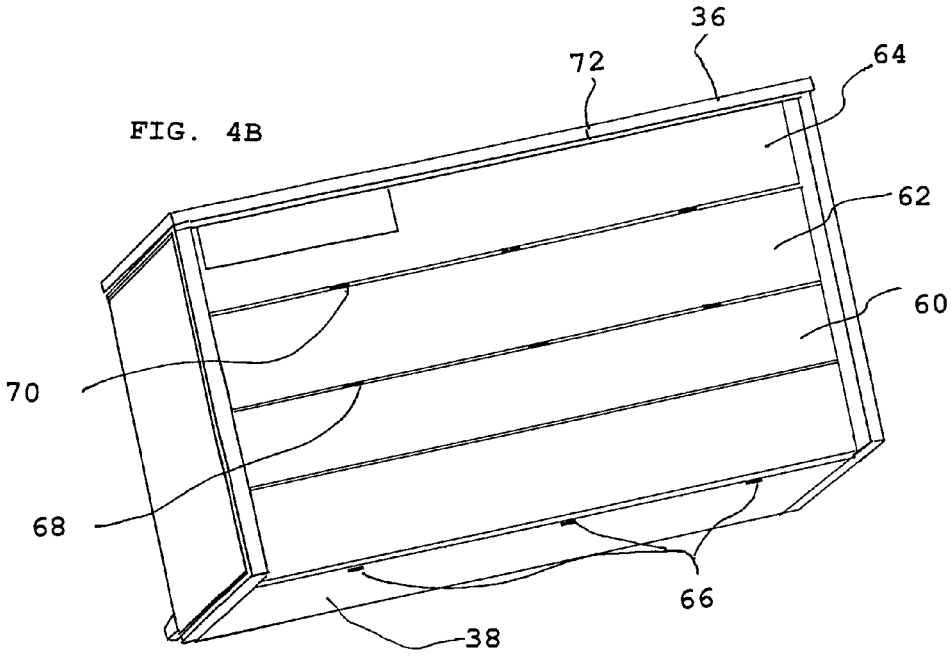
FIG. 4B is a plan view of the rear of the cabinet shown in FIG. 4A but with the support panels closed.
Figure 4C:
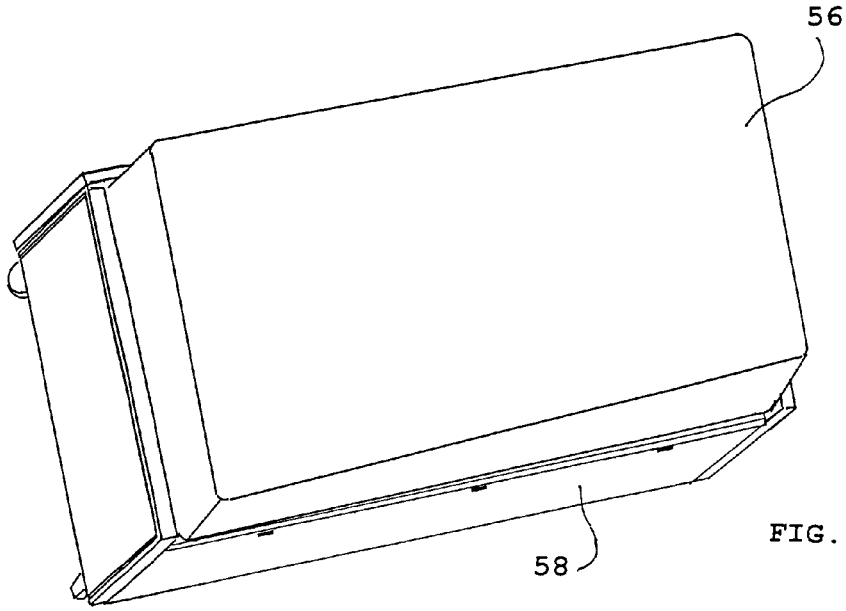
FIG. 4C is a plan view similar to FIG. 4B but with a mattress positioned upon the closed support panels.
Figure 5C:
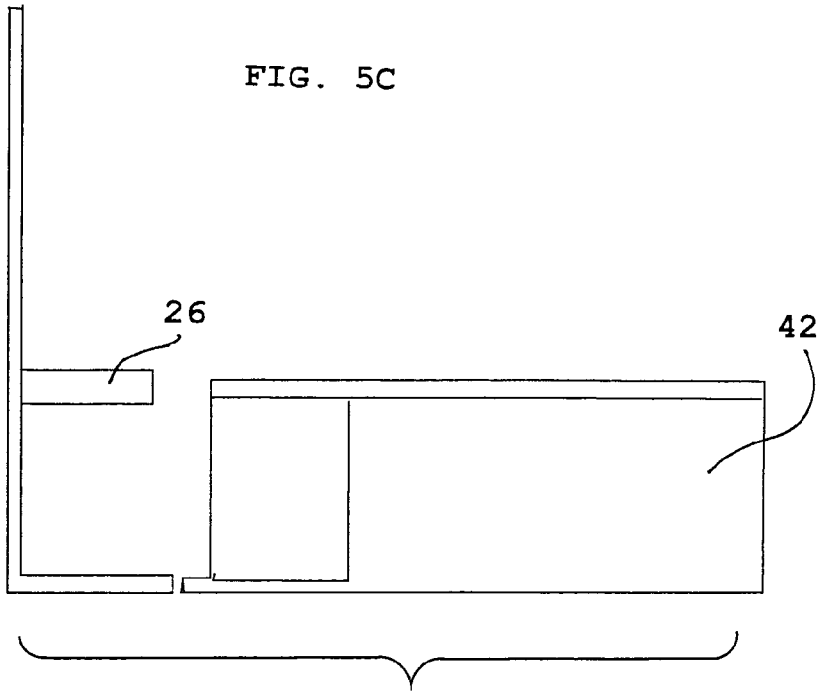
FIG. 5C is a side elevational view similar to FIG. 5B but with the cabinet rotated 90 degrees from the day time vertical orientation to the night time horizontal orientation.
Figure 5D:
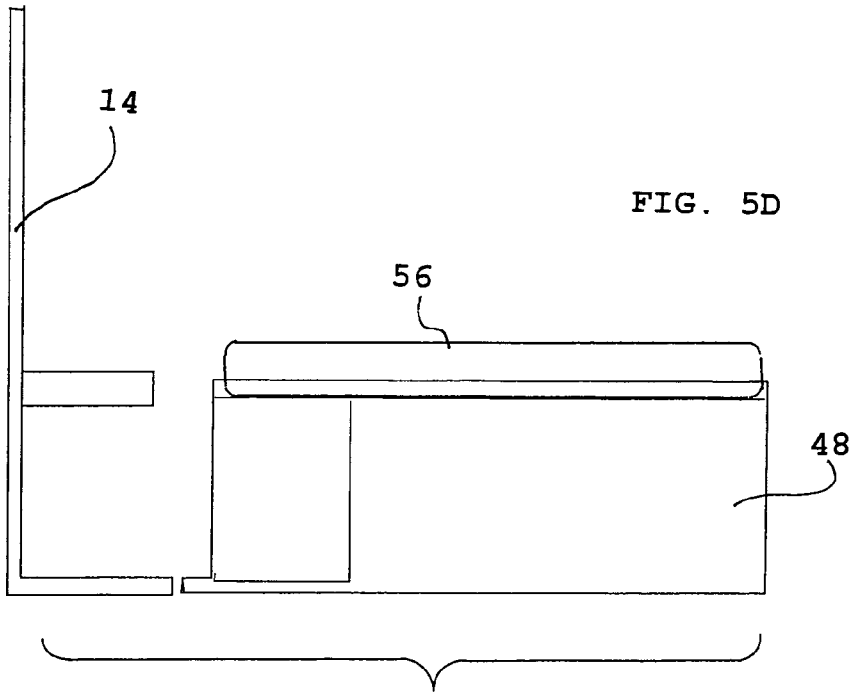
FIG. 5D is a side elevational view similar to FIG. 5C but with the mattress positioned upon the panels of the cabinet.

One optional feature of the invention is a small door 74 as shown in FIG. 4A. One or more of such doors is adapted to be formed in any one or more of the panels. This feature allows access by a user to the openings of the cabinet as well as to the housings when the cabinet is in the horizontal orientation and the openings are covered by the panels.

The furniture system of the present invention has a plurality of configurations such as, but not limited to, a bed, sofa and shelf of which, in its storage phase, the components of the system are formed as a shelf configuration with open and closed front thus, not only requiring minimal space to store the components of the system, it is a functional shelf for storing and also displaying desired objects. The other unique capability of the present invention is that the objects stored or displayed on the shelves can remain on the shelves when the components of this furniture system is used in its other configuration such as a bed.

Figure 6:
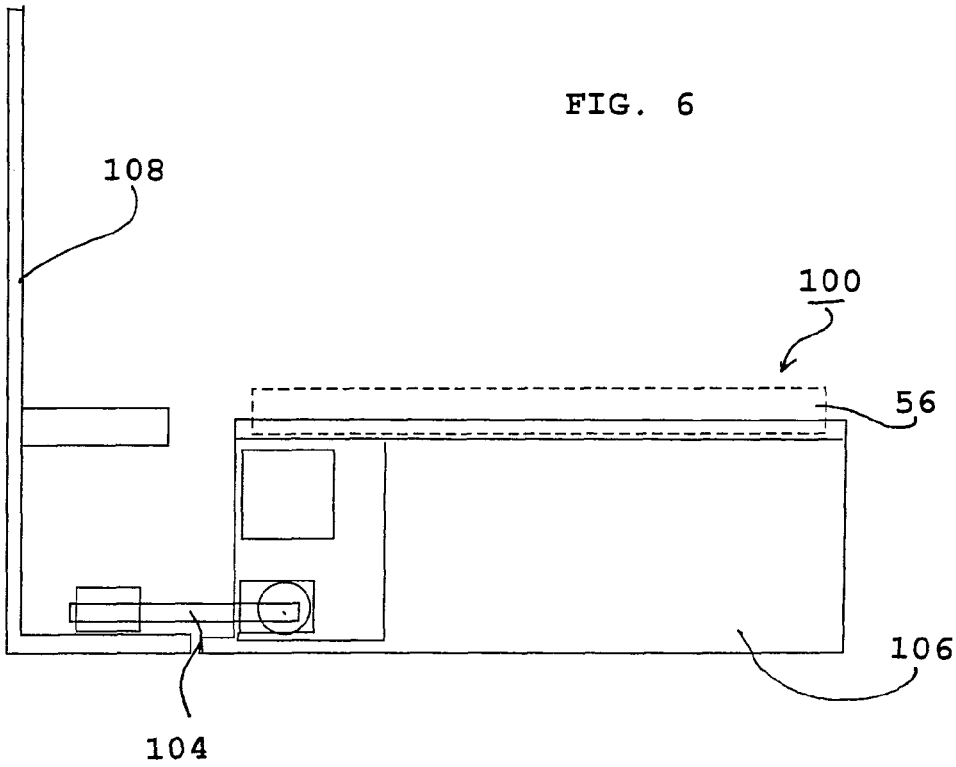
FIG. 6 is a side elevational view similar to FIG. 5D but illustrating an alternate embodiment of the invention wherein the movement of the cabinet between the vertical orientation and the horizontal orientation is achieved automatically.

An alternate embodiment of the invention is illustrated in FIG. 6. In this embodiment, the system 100 includes drive mechanisms 104 operatively coupling the cabinet 106 and the back plate 108 for providing movement of the cabinet with respect to the back plate between a horizontal orientation and a vertical orientation.

Another alternate embodiment of the invention is an optional night stand. Such night stand is adapted to be pivotably coupled to the cabinet for supporting objects such as a lamp and a clock when the cabinet is in the horizontal orientation for use as a bed.

Figure 7:
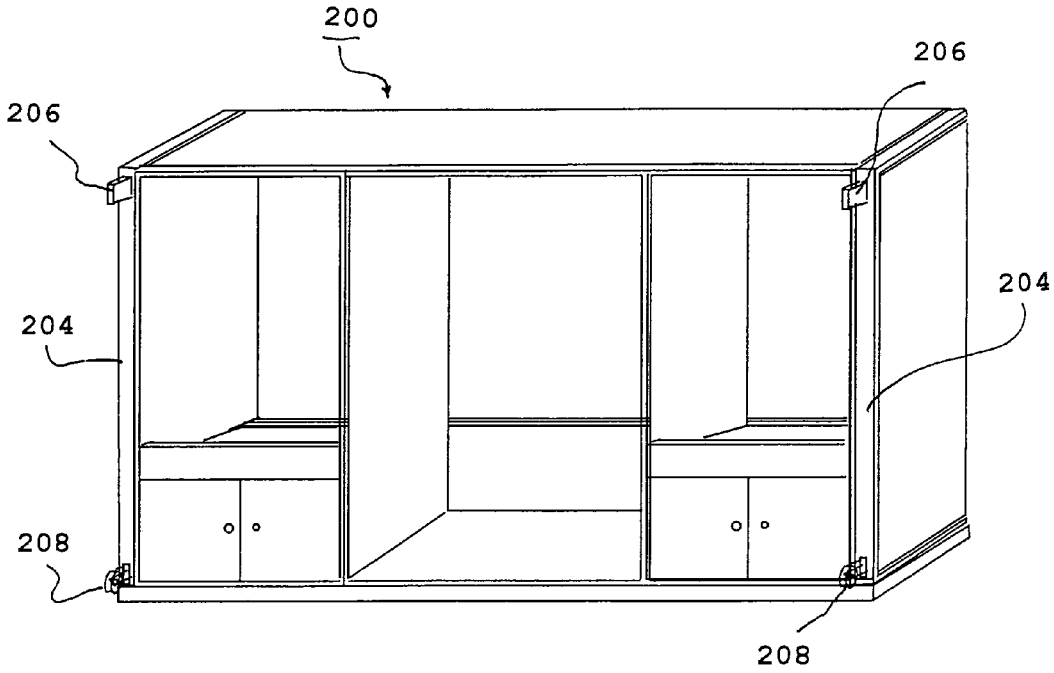
FIG. 7 is a view similar to FIG. 1 but illustrating another alternate embodiment of the invention wherein retractable wheels and legs facilitate moving the cabinet when in the horizontal orientation.

A final alternate embodiment of the invention is illustrated in FIG. 7. In this embodiment, the system 200 includes a front periphery 204 on the cabinet. The front periphery has two retractable legs 206 adjacent to the upper plate. The front periphery has two retractable wheels 208 adjacent to the lower plate to facilitate moving the cabinet when in the horizontal orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-functional, reconfigurable furniture system comprising:

a back plate having a bottom plate, upper and lower edges and side edges, the back plate being formed with a central section and two laterally spaced side sections with spaces separating the sections, shelves coupled to the back plate in the sections;

a cabinet having upper and lower plates and left and right side plates, the cabinet having a left intermediate plate and a right intermediate plate, a central opening between the left intermediate plate and the right intermediate plate, a left side opening between the left side plate and the left intermediate plate, a right side opening between the right side plate and the right intermediate plate, the cabinet positionable upon the bottom plate of the back plate when in a vertical orientation;

a plurality of support panels coupled to the cabinet, the support panels being re-positionable for spanning the openings when the cabinet is in a horizontal orientation whereby the panels will totally cover the openings and provide full support for an inflated mattress; and two box-shaped shelving assemblies, one of the shelving assemblies in each side opening adjacent to the upper plate of the cabinet.

2. The system as set forth in claim 1 and further including an inflatable mattress positionable in one of the shelving assemblies when deflated and positonable upon the support panels when inflated.

3. A multi-functional, reconfigurable furniture system (10) for conversion to a cabinet during the day and for conversion to a bed during the night, the system comprising, in combination:

a back plate (14) having a horizontal upper edge (16) and a parallel lower edge (18) separated by a height of 6 feet, the back plate having a vertical left side edge (20) and a parallel right side edge (22) separated by a width of 7 feet, the back plate being vertically positionable against and secured to a wall, a foot plate (24) attached to the lower edge of the back plate, the foot plate having a width equal to the width of the back plate, the foot plate extending forwardly from the back plate for a depth equal to 25 percent of the height of the back plate, the back plate being formed with a vertical central section and two laterally spaced side sections and with vertical spaces separating the sections, a horizontal major shelf (26) in the central section and two minor shelves (28), each of the minor shelves being in each of the side sections, two box-shaped shelving assemblies (30), one shelving assembly in each side section, the minor shelves and the shelving assemblies having a common width, the major shelf having a width greater than the common width;

a cabinet (34) having a horizontal upper plate (36) and a parallel lower plate (38) separated by a height of 6 feet, the cabinet having a vertical left side plate (40) and a parallel right side plate (42) separated by a width of 7 feet, the cabinet having a left intermediate plate (44), a right intermediate plate (46), a central opening between the intermediate plates, a left side opening between the left side plate and the left intermediate plate, a right side opening between the right side plate and the right intermediate plate, a left housing (48) with front doors, the left housing being in the left side opening and being secured to the lower plate and having a height of 1.5 feet, a right housing (50) with front doors, the right housing being in the right side opening and being secured to the lower plate and having a height of 1.5 feet, the cabinet movable between a horizontal orientation and a vertical orientation, the horizontal orientation positioning the cabinet upon the floor laterally spaced from the foot plate with the upper and lower plates vertically disposed, the vertical orientation positioning the cabinet upon the foot plate and against the back plate and with the intermediate plates separating the major shelf from the minor shelves and with the upper and lower plates horizontally disposed;

an inflatable mattress (56) adapted to be deflated and inserted into one of the housings when the cabinet is in the vertical orientation, the inflatable mattress adapted to be inflated and placed upon the cabinet when in the horizontal orientation; and four similarly configured support panels (58)(60)(62)(64) coupled to the cabinet, the panels including a lower panel (58) with hinges (66) for pivoting the foot panel to a position facing the lower panel when in the vertical orientation and to a position spanning the openings when in the horizontal orientation, the panels including three upper panels (60)(62)(64) with hinges (68)(70)(72) for folding and stacking the three upper panels (60)(62)(64) upon the upper plate when the cabinet is in the vertical orientation, the support panels re-positionable for spanning the openings when in the horizontal orientation, whereby the panels will totally cover the openings and provide full support for the inflated mattress.

* * * * *